US006962676B1

(12) United States Patent
Hyppänen

(10) Patent No.: US 6,962,676 B1
(45) Date of Patent: Nov. 8, 2005

(54) METHOD AND APPARATUS IN A FLUIDIZED BED HEAT EXCHANGER

(75) Inventor: Timo Hyppänen, Karhula (FI)

(73) Assignee: Foster Wheeler Energia Oy, Helsinki (FI)

( * ) Notice: Subject to any disclaimer, the term of this patent is extended or adjusted under 35 U.S.C. 154(b) by 0 days.

(21) Appl. No.: 09/806,469

(22) PCT Filed: Sep. 29, 1999

(86) PCT No.: PCT/FI99/00797

§ 371 (c)(1),
(2), (4) Date: Jul. 9, 2001

(87) PCT Pub. No.: WO00/20818

PCT Pub. Date: Apr. 13, 2000

(30) Foreign Application Priority Data

Oct. 2, 1998 (FI) ..... 982135

(51) Int. Cl.[7] ..... F27B 15/00

(52) U.S. Cl. ..... 422/142; 422/141; 422/143; 422/146

(58) Field of Search ..... 422/139, 141, 422/142, 143, 146

(56) References Cited

U.S. PATENT DOCUMENTS

| | | | | |
|---|---|---|---|---|
| 2,631,967 A | * | 3/1953 | Alleman et al. | 208/148 |
| 2,651,565 A | * | 9/1953 | Bergman | 422/143 |
| 2,690,962 A | * | 10/1954 | Clarke | 422/143 |
| 3,883,344 A | * | 5/1975 | Griffith et al. | 423/45 |
| 4,561,262 A | | 12/1985 | Fredrixon | 62/62 |
| 4,781,574 A | | 11/1988 | Taylor | 431/7 |
| 4,796,691 A | | 1/1989 | Large et al. | 165/104 |
| 4,813,479 A | * | 3/1989 | Wahlgren | 165/104.16 |
| 5,133,943 A | | 7/1992 | Abdulally | 422/145 |
| 5,141,708 A | | 8/1992 | Campbell, Jr. et al. | 422/142 |
| 5,463,968 A | * | 11/1995 | Abdulally | 110/347 |
| 5,510,085 A | * | 4/1996 | Abdulally | 422/142 |
| 5,526,775 A | | 6/1996 | Hyppänen | 122/235.11 |
| 5,533,471 A | | 7/1996 | Hyppänen | 124/4 D |
| 5,566,750 A | | 10/1996 | Arpalahti et al. | 165/104.16 |
| 5,570,645 A | | 11/1996 | Garcia-Mallol | 110/245 |
| 6,336,500 B2 | * | 1/2002 | Hyppanen | 165/96 |

FOREIGN PATENT DOCUMENTS

| | | |
|---|---|---|
| DE | 3726643 | 5/1988 |
| EP | 0199655 | 10/1986 |
| EP | 0325042 | 7/1989 |
| EP | 0365723 | 5/1990 |
| EP | 0413611 | 2/1991 |
| FI | 85909 | 2/1992 |
| FI | 102316 | 11/1998 |
| JP | 63-74912 | 5/1988 |
| JP | 5-52316 | 3/1993 |
| JP | 8-503292 | 4/1996 |
| JP | 9-60801 | 3/1997 |
| JP | 9-512093 | 12/1997 |

* cited by examiner

*Primary Examiner*—Kiley S. Stoner
*Assistant Examiner*—Len Tran
(74) *Attorney, Agent, or Firm*—Fitzpatrick, Cella, Harper & Scinto

(57) ABSTRACT

A method and an apparatus in a fluidized bed heat exchanger including a heat exchange chamber having a fluidized bed of solid particles, heat transfer surfaces, an inlet, and an outlet. Particles are fed through the inlet onto the upper surface of the bed of solid particles by a guiding channel. The guiding channel, which extends from above the upper surface of the bed of solid particles to the surface thereof, or to below the surface, passes the solid particles to the restricted area of the surface. The outlet is formed in the area of the guiding channel to remove particles from the area delimited by the guiding channel. Uncooled particles can thus be removed from the heat exchange chamber.

26 Claims, 3 Drawing Sheets

METHOD AND APPARATUS IN A FLUIDIZED BED HEAT EXCHANGER

BACKGROUND OF THE INVENTION

The present invention relates to a method and an apparatus in a fluidized bed heat exchanger.

In particular, the present invention relates to a method and an apparatus, by which heat transfer may be adjusted in a fluidized bed heat exchanger. The apparatus includes a heat exchange chamber having a bed of solid particles, means for feeding fluidization gas into the heat exchange chamber, heat transfer surfaces in contact with the bed of solid particles, an inlet arranged in the top portion of the heat exchange chamber above the upper surface of the bed of solid particles, and a first outlet for removing solid particles from the heat exchange chamber. The method, meanwhile, typically includes steps of feeding solid particles through the inlet to the upper surface of the bed of solid particles in the heat exchange chamber, fluidizing the bed of solid particles in the heat exchange chamber fluidization gas, transferring heat by the heat transfer surfaces from the fluidized bed of solid particles, and removing solid particles from the heat exchange chamber through the first outlet.

Fluidized bed heat exchangers are generally used in various pressurized and atmospheric fluidized bed reactor systems, for example, in different combustion and heat transfer processes and chemical and metallurgic processes. Heat typically generated by combustion or other exothermic processes is recovered from solid particles by utilizing heat transfer surfaces. The heat transfer surfaces conduct the recovered heat to a medium, such as water or steam, which transfers the heat out of the reactor.

Heat transfer surfaces may be arranged in different parts of the reactor system, for example, in special heat exchange chambers, which may be a part of the reaction chamber, a separate chamber connected to the reaction chamber, or, as in circulating fluidized bed reactors, a part of the circulation system of solid particles.

In many applications of fluidized bed reactors, including in steam boilers, for example, it is important to be able to adjust the heat transfer continuously and accurately within a wide control range. Reasons for such adjustments may be a changing demand for steam production, a deviation in the fuel quality or in the feed of the fuel, or some other abnormality in the system. It may also be necessary to adjust the system to a correct operational state. Further reasons why it may be necessary to adjust the heat transfer in steam boilers have to do with the fact that heat is generally recovered at several stages, i.e., in evaporators, superheaters, economizers, and reheaters, which may need individual adjustment.

The purpose of adjusting the heat transfer efficiency in a fluidized bed reactor with respect to the processes is to maintain an optimum operational state in terms of emissions and efficiency in the reactor. Often this means that the temperature of the reactor should continue to be constant even when the heat transfer efficiency and the feed volumes of the fuel fluctuate.

When designing a heat exchange chamber, the most important considerations are a simple structure, continuous adjustability within a wide adjustment range, and minimal space requirements.

One way to adjust the heat transfer efficiency of a fluidized bed heat exchanger is to change the volume of the fluidized bed material in the heat exchange chamber so that a varying portion of the heat transfer surfaces is covered by solid particles. Such a structure is disclosed, for example, in U.S. Pat. No. 4,813,479. In the disclosed arrangement, however, an additional flow channel and an adjustment valve are required, which makes the system more complicated and increases the costs. Further, when changing the height of the bed, part of the heat transfer surfaces may be exposed to considerable erosion.

U.S. Pat. No. 5,140,950 discloses an arrangement wherein the circulation flow of hot solid particles in a circulating fluidized bed reactor is divided by a number of compartments and channels into two separate chambers, only one of which includes heat transfer surfaces. By changing the division ratio of the solid particles flowing through the various chambers, it is possible to vary the heat transfer efficiency of the heat exchanger. However, the disclosed arrangement is complicated and—in terms of space consumption—disadvantageous.

A bubbling fluidized bed is usually maintained in the heat exchange chamber where the speed of the fluidization gas may be, when using bed material with small particle size, for example, 0.1–0.5 m/s. The heat transfer efficiency of the fluidized bed heat exchanger may be varied to some extent by changing the speed of the fluidization gas. This is due to the fact that the solid particles move more vividly at high speeds of the fluidization gas than they do at low speeds, whereby the hot particles spread at high speeds efficiently throughout the entire heat exchange chamber. At high speeds, no separate cooled layers are allowed to form in close proximity to the heat transfer surfaces, which could decrease the heat transfer, nor will the hot particle flows entering the heat exchanger be passed directly from the inlet of the heat exchange chamber to the outlet without mixing with the particles in the chamber.

U.S. Pat. No. 5,425,412 discloses an arrangement in a circulating fluidized bed reactor, in which the heat exchange chamber includes separate areas for transferring particles and for heat transfer, respectively. Heat transfer efficiency is adjusted by changing the moving intensity of the particles close to the heat transfer surfaces and the mixing rate of the material by utilizing the fluidization gas velocities of different areas. By changing the mixing rate of the material, the relation between the hot particles newly flown to the chamber and the particles already cooled in the exiting particle flow is varied. In different situations, particles may be discharged through an overflow opening in the bed surface and/or through an outlet in the lower portion of the chamber. The adjustment range of the heat transfer efficiency in this kind of a heat exchange chamber may, however, remain rather limited. To avoid agglomeration and overheating of the bed due to possible after-burning, the bed of solid particles must be maintained continuously fluidized, so that the mixing rate is always fairly high. Further, due to the use of a separate transfer area, the space utilization is not optimal, since a considerable part of the heat exchange chamber is not in efficient use with respect to the heat transfer.

SUMMARY OF THE INVENTION

It is an object of the present invention to provide an improved method and apparatus, in which the above-mentioned problems and defects of the prior art methods and apparatuses are minimized.

It is a more specific object of the invention to provide an improved method and apparatus that allows for easy adjustment of the heat transfer efficiency of a fluidized bed heat exchanger over a wide efficiency range.

It is still a further object of the present invention to provide a durable and simple, reasonable-cost, and space-saving fluidized bed heat exchanger.

The basic idea of the method and apparatus in accordance with the present invention is to be able to restrict the mixing of hot solid particles flowing into the fluidized bed heat exchanger with the bed of solid particles consisting of those solid particles that have come into contact with heat transfer surfaces and/or have otherwise been already cooled. Thus, the purpose is to either partly or even completely prevent the mixing of hot solid particles with the bed of solid particles.

The mixing of hot solid particles with the bed of solid particles is restricted by a guiding channel arranged in the fluidized bed heat exchanger to extend from above the surface of the bed of solid particles to the bed of solid particles, and by arranging a first outlet in the area defined by the guiding channel. Hot particles fed through an inlet into the heat exchange chamber may thus be passed by the guiding channel to a particular area, substantially defined by the guiding channel, onto the upper surface of the bed of solid particles. Moreover, when the first outlet of the heat exchange chamber is arranged in the area defined by the guiding channel, it is possible to remove hot solid particles directly from this area, for example, as an overflow from the upper surface of the solid particle bed or from below the surface through an adjustable outlet or opening, without allowing the particles to be removed to come into contact with the cooled solid particles.

In a typical arrangement in accordance with the invention, a guiding channel is arranged in the top portion of the heat exchange chamber so that the guiding channel extends from the inlet to the bed of solid particles to either the bed surface or to a short distance below the surface. In some cases, the desired guiding of the solid particles is accomplished also by a guiding channel, the lower end of which does not quite reach this surface. Typically, the location of the first outlet determines the distance the lower end of the guiding channel is to extend inside the bed, if at all. The guiding channel is preferably formed of an intermediate wall extending from the top portion of the heat exchange chamber to the bed of solid particles, with the guiding channel being defined by a wall of the heat exchange chamber and the intermediate wall.

When the speed of the fluidization gas in the heat exchange chamber is low, and the mixing of particles in the heat exchange chamber and, thus, also in the area of the guiding channel, is minimal or even virtually nonexistent, it is possible to remove the majority or even all of the hot particles flowing into the heat exchanger through the first outlet without substantially transferring any heat to the bed and to the heat transfer surfaces. The heat transfer efficiency of the heat exchanger is thereby minimal.

The heat transfer efficiency may be increased by raising the velocity of the fluidization gas, thus intensifying the mixing of particles also within the area of the guiding channel, whereby at least a portion of the hot solid particles, or even all of them, releases heat to the bed and thereby to the heat transfer surfaces as well. In this case, cooled solid particles are removed from the heat exchanger through the first outlet or through a second outlet arranged in the lower part of the bed.

According to the invention, it is thus possible to restrict the mixing of the cooled solid particles in the bed and the hot solid particles to be removed through the first outlet by passing the hot solid particles to a restricted area on the upper surface of the solid particle bed, from where a portion of the solid particles may be removed from the heat exchanger in an uncooled state. Thus, it is possible to prevent or at least substantially restrict the heat transfer from the specified portion of the solid particles to the solid particle bed and, thereby, to the heat transfer surfaces. By utilizing the arrangement according to the present invention, it is possible to decrease the bed temperature and the amount of heat energy to be recovered by the heat transfer surfaces. Thus, it is possible, by passing a portion of the particles in an uncooled state out of the heat exchanger, to decrease the smallest possible heat transfer efficiency acquired by each incoming flow of hot particles.

In the arrangement in accordance with the present invention, it is possible to provide a second outlet in the heat exchange chamber; for example, in the lower portion of the chamber, through which the solid particle flow can be controlled. Thus, it is possible, when producing a high heat transfer efficiency, to let the whole incoming particle flow exit through the second outlet, whereby the means restricting the mixing in the area of the first outlet do not substantially affect the mixing rate. That way, the highest possible heat transfer efficiency does not change either.

It is typical of the method in accordance with the present invention that the particle flow entering the heat exchanger is passed to the surface of the solid particle bed by means extending slightly below the surface to an area defined by such means. The criterion for selecting this restricted area is its connection to the first outlet. The cross-sectional surface area of the restricted area is, at the level of the first outlet, generally substantially smaller than the average cross-sectional surface area of the particle bed in the heat exchange chamber. The cross-sectional surface area defined by the means is preferably, at the level of the lower surface of the first outlet, at most 30%, preferably at most 10%, of the average cross-sectional area of the particle bed in the heat exchange chamber.

The means restricting the mixing are typically arranged in such a way that they penetrate only over a short distance into the upper part of the bed of solid particles, so that the channel or gap formed by them in the bed, where typically no heat transfer surfaces are arranged, would not produce any major waste space in the bed in view of the heat transfer. Thus, the means restricting the mixing preferably extend into the bed over a distance which is at most 30%, most preferably at most 20%, of the depth of the bed. Typically, the restricting means extend about 10–50 cm, most typically approximately 20–30 cm, into the bed.

According to a first preferred embodiment of the present invention, the heat exchanger in accordance with the present invention is incorporated in a circulating fluidized bed reactor or boiler. The heat exchanger is arranged between the furnace and the return duct of the particle separator in the solids circulation of the reactors, i.e., the tube, through which particles are returned from the particle separator to the furnace of the reactor. The inlet of the heat exchanger is connected to the return duct and the outlet, for example, an overflow opening, leads to the furnace. A first portion of the particles is preferably passed from the return duct in a substantially uncooled state as an overflow to the furnace. A second portion of the particles is passed to the solids bed in the heat exchange chamber where heat is transferred from the particles to the heat transfer surfaces before the particles are returned to the furnace. The portion to be removed from the circulation as an overflow, possibly varying from 0 to 100%, varies according to the load of the boiler, fuel, and volume of the circulation flow, for example.

According to another preferred embodiment, it is possible to apply the invention to a circulating fluidized bed reactor or bubbling bed reactor, in which solids are passed directly to a heat exchanger from a reaction chamber/furnace. In this case, the heat exchanger is preferably arranged immediately outside the reaction chamber of the reactor, and the heat exchanger and the reaction chamber preferably share a common wall with openings arranged therein forming an inlet for introducing particles into the heat exchange chamber, and an overflow conduit for immediate return of the particles as an overflow to the reaction chamber. These openings may be very close to each other. One and the same opening may in some cases act even in both directions, i.e., alternate in acting as an inlet in one direction and as an overflow opening in another direction. On the other hand, in some cases, the same opening can serve as both an inlet and an outlet, with the upper part of the opening operating as an inlet and the lower part as an outlet.

When a fluidized bed heat exchanger is located directly in communication with the reaction chamber of a fluidized bed reactor, often the openings have to be arranged in such a way that material is gathered from a wide area to produce a sufficient material flow. In this case, it is particularly important that the incoming material is passed to a small area on the upper surface in the fluidized bed and is not allowed to spread throughout this wide surface, where it would inevitably mix with the material that is already in the fluidized bed. By restricting the incoming particle flow to a small area, the unnecessary mixing of the material to be removed as an overflow with the rest of the fluidized bed material is restricted as well.

A second outlet for the cooled particles of the heat exchanger is preferably formed at the bottom of the heat exchange chamber, from where particles are passed in a manner known per se, for example, to the furnace. On the other hand, in the above-mentioned embodiments, the discharge of cooled particles may be designed to take place through a lifting channel arranged between the heat exchange chamber and the furnace. The bottom of the lifting channel communicates with an outlet in the lower portion of the heat exchange chamber, and preferably shares a common wall with the furnace. Particles are passed from the lifting channel, for example, as an overflow to the furnace.

The arrangement in accordance with the present invention is preferably realized in such a way that the heat exchange chamber has only one continuous fluidized bed of solid particles. Above the fluidized bed, the heat exchange chamber is provided with means, e.g., an intermediate plate or a baffle, that substantially restricts the spreading of the solid particles introduced through the inlet on the bed of solid particles, thus restricting their mixing with the fluidized bed of solid particles as well. When using low fluidization gas velocities, only a first portion of the particles fed to the small area generally is mixed with the bed of solid particles. Such portion corresponds to the amount of particles flowing from the inlet through the heat exchange chamber to the outlet in the lower portion of the heat exchange chamber.

When the demand for heat transfer efficiency is small, the particle flow flowing through the heat exchanger, i.e., the particle flow coming in and flowing out, is allowed to pass only through a restricted area of the upper surface of the solid particle bed, whereby the solid particle exchange between the exiting flow and the bed of solid particles is small. Particles that have not yet had time to settle in the area of efficient mixing of the bed, and thus, which have not yet released any heat to the solids bed, may be readily removed as an overflow from the thick layer of hot particles formed in a small area.

In the arrangement in accordance with the invention, only the amount of material flow necessary for the heat transfer is mixed with the bed of solid particles in the heat exchange chamber, with the excess returning in a hot state from the upper surface of the bed to the reaction chamber, and thus, without substantially mixing with the fluidized bed in the heat exchange chamber.

In a heat exchange chamber in accordance with the invention, an efficient and wide-ranging adjustment of heat transfer may be realized simply by adjusting the velocity of the fluidization gas, and if necessary, by further adjusting the discharge of solid particles through a second outlet. By intensifying the particle flow through the second outlet, the amount of uncooled particles flowing through the first outlet is decreased and the amount of particles coming into communication with the heat transfer surfaces is increased. Conversely, by decreasing the particle flow through the second outlet, the immediate discharge of hot particles from the heat exchanger through the overflow opening is increased.

In the arrangement in accordance with the invention, it is not necessary to divide the heat exchanger by intermediate walls into separate beds of solid particles provided with an individual fluidization.

BRIEF DESCRIPTION OF THE DRAWINGS

The invention is described below more closely with reference to the accompanying drawings, in which.

DESCRIPTION OF THE PREFERRED EMBODIMENTS

Figure 1:
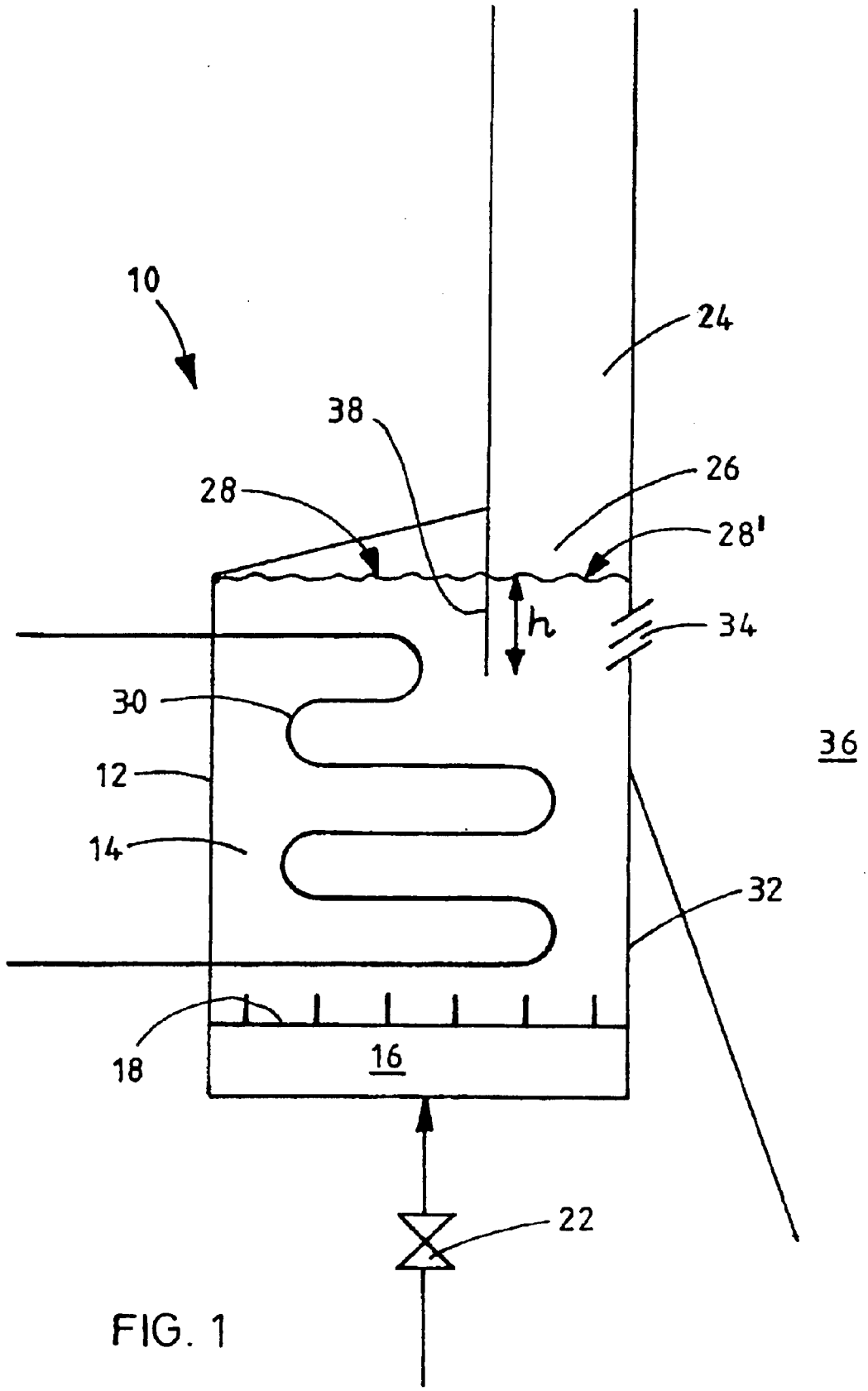
FIG. 1 schematically illustrates a vertical, cross-sectional view of a fluidized bed heat exchanger in accordance with the invention.

FIG. 1 schematically illustrates a simple heat exchanger 10, in the heat exchange chamber 12 of which a slow fluidized bed 14 comprising hot solid particles is maintained by feeding fluidization gas into it from a wind box 16 through a grid 18. Heat transfer surfaces 30 are arranged in the fluidized bed for the recovery of heat from the fluidized bed. The flow of the incoming fluidization gas from the wind box through the grid 18 may be adjusted by a valve 22, for example, to control the quantity of heat that is transferred to the heat transfer surfaces.

The top portion of the heat exchange chamber 12 above the fluidized bed 14 is provided with an inlet 24, from which hot solid particles flow through a guiding channel 26 onto the surface 28 of the fluidized bed 14.

Heat is recovered from the hot particles entering the fluidized bed in the heat exchange chamber 12 by transferring the heat energy of the hot solid particles to a medium, usually steam or water, contained in the heat transfer surfaces 30. The top portion of the heat exchange chamber 12 immediately below the surface 28 of the fluidized bed 14 is provided with an outlet 34 in the wall 32 thereof, through which solid particles are removed from the heat exchange chamber to the adjacent space 36, typically being, for example, a furnace. The outlet 34 is preferably a so-called gill-seal type block provided with a gas lock, such as disclosed in Finnish Patent Application No. FI 952193 of the applicant. A separate feed for fluidization air possibly required by the "gill-seal" type outlet is not illustrated in FIG. 1. The outlet may also be another kind of a conduit or an opening, the opening extent and flow-through of which is adjustable.

Continuous fluidization must often be maintained in the particle bed 14 to prevent agglomeration of the bed and local overheating. To prevent the hot solid particles flowing through the inlet 24 to the upper surface of the bed from mixing rapidly with the bed 14 due to fluidization, a baffle or an intermediate wall 38 that considerably restricts such mixing is arranged in the heat exchange chamber. The intermediate wall 38 forms one of the guiding channel 26 walls.

The intermediate wall 38 arranged in the top portion of heat exchange chamber 12 between the inlet 24 and the upper surface 28 of the fluidized bed 14 passes the hot solid particles through the inlet 24 toward an area 28' on the upper surface 28 of the fluidized bed defined by the intermediate wall 38 and the wall 32 of the heat exchange chamber. The intermediate wall 38 and the wall 32 of the heat exchange chamber 12 form a guiding channel 26 extending over and partly into the fluidized bed. The intermediate wall 38 extends lower than the lower edge of the outlet and, at the guiding channel, prevents the free movement of the material entering the heat exchange chamber within the restricted area 28' near the surface 28 of the fluidized bed 14. On the other hand, in order to avoid a major waste space, the guiding channel 26 formed by the wall 32 of the heat exchange chamber 12 and the intermediate wall 38 should not be too long. In the example of FIG. 1, the length of the guiding channel portion in the solid particle bed is less than 30% of the depth of the bed. The intermediate wall 38 extends over a distance $11h''$ into the fluidized bed, the distance typically being 10–50 cm.

The cross-sectional area $A_1$ of the area 28' of the surface 28 of the fluidized bed that is restricted by the guiding channel is at most 30% of the average cross-sectional area $A_2$ of the fluidized bed. Thus, the solid particles flowing through the inlet 24 to the fluidized bed, which particles in a heat exchange chamber not equipped with intermediate walls would spread throughout the entire upper surface of the fluidized bed, are packed within the area defined by the guiding channel 26 in the arrangement in accordance with the invention.

When low heat transfer efficiency is desired using a heat exchange chamber in accordance with FIG. 1, a fluidization gas velocity as low as possible has to be used, i.e., a so-called minimum fluidization, by which solid particles still move relative to each other. If the intermediate wall 38 did not exist, the hot solid particles entering through the inlet 24 would be allowed to spread throughout the entire surface 28 of the solid particle bed, whereby they would efficiently mix with the bed 14 of solid particles regardless of the low velocity of the fluidization gas. In the arrangement of FIG. 1 in accordance with the invention, the intermediate wall 38 passes the hot solid particles entering through the inlet to the restricted area 28' on the upper surface of the solid particle bed. When using a low fluidization gas velocity, the mixing of the hot solid particles forced to the restricted bed area 28' is slow or practically no mixing takes place at all. Because the outlet 34 is in the area of the solid particle bed defined by the guiding channel 26, hot solid particles newly entering the heat exchange chamber mainly through the inlet 24 and not yet mixing with the particles in the bed, are discharged from the heat exchange chamber 12 through the outlet 34. Since no substantial quantities of hot particles enter the bed, the temperature of the bed 14 remains substantially low and the heat transfer minor.

On the other hand, if high heat transfer efficiency is desired using a heat exchange chamber in accordance with FIG. 1, a high fluidization gas velocity has to be used. In this case, the entire solid particle bed is in a very intensive inner movement, whereby the particles entering through the inlet 24 mix rapidly with the solid particle bed 14 in the heat exchange chamber, regardless of the intermediate wall 38. Thus, almost the entire bed of solid particles, including most of the bed portion defined by the guiding channel 26, is substantially at the same temperature and its heat transfer efficiency is maximized.

According to the above description, the intermediate wall 38 diminishes the lowest possible heat transfer efficiency available in the heat exchange chamber 12, but it does not substantially affect the highest possible heat transfer efficiency available. Thus, the intermediate wall restricting the mixing makes the adjustment range of the heat transfer in the heat exchange chamber considerably wider, which is of great importance in many applications of heat exchange chambers.

Figure 2:
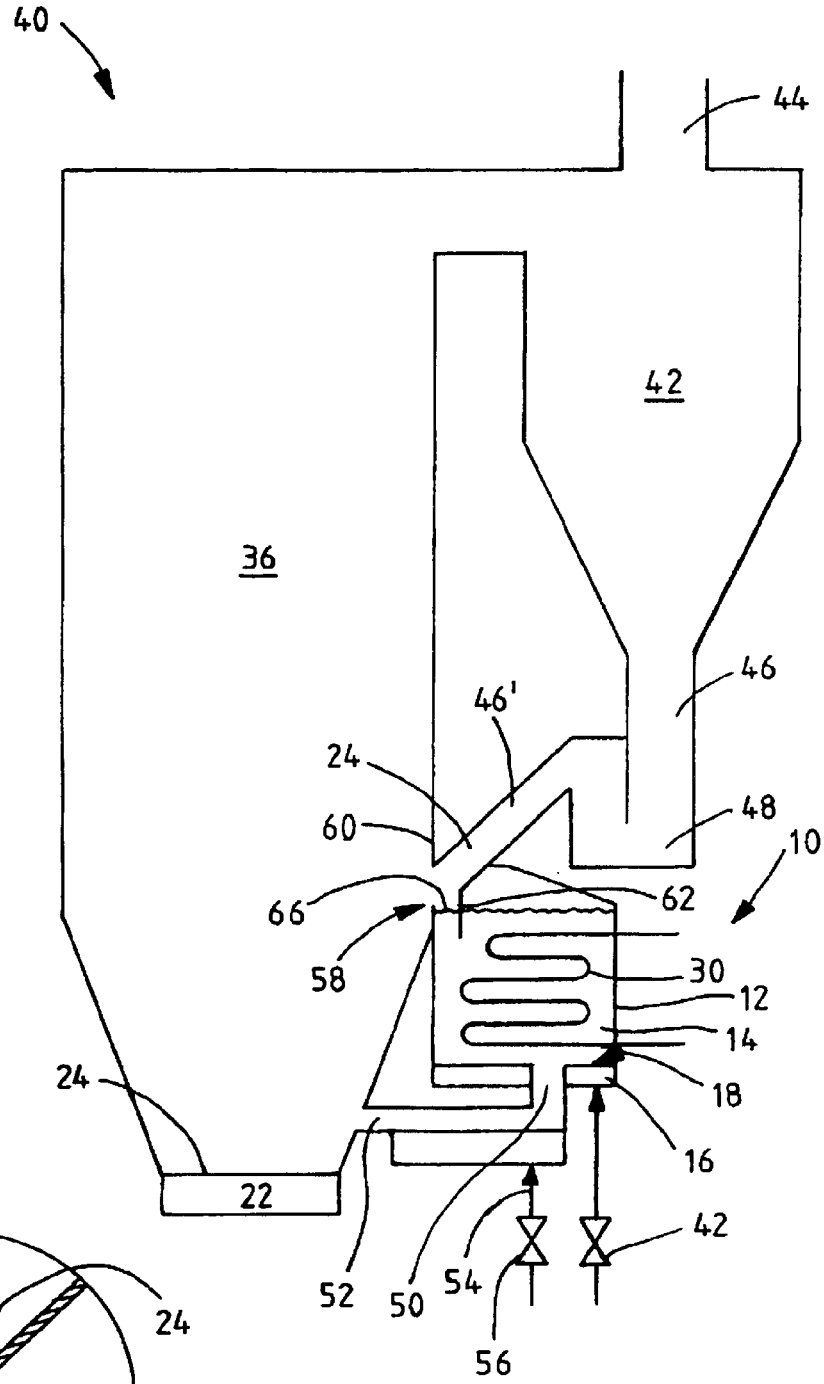
FIG. 2 schematically illustrates a cross-sectional view of a circulating fluidized bed boiler provided with a heat exchanger in accordance with the first embodiment of the invention.

FIG. 2 illustrates a heat exchanger connected to a circulating fluidized bed boiler in accordance with the invention. In FIG. 2, the same reference numbers are used as in FIG. 1, wherever possible.

FIG. 2 thus illustrates a circulating fluidized bed boiler 40, comprising a furnace 36, a particle separator 42, a gas outlet pipe 44, and a return duct 46 for solid particles, including a gas lock 48. A fast fluidized bed comprising hot solid particles is maintained in the furnace 36 by feeding fluidization gas to the bed from a wind box in a manner known per se, so that solid particles are entrained with the exit gas through an opening in the top portion of the furnace to the particle separator 42. The particle separator separates most of the hot solid particles from the exit gas and the separated solid particles are returned to the furnace 36 through the return duct 46 arranged in the lower portion of the separator.

In communication with the return duct 46 is arranged a heat exchanger 10 in accordance with the invention, in the heat exchange chamber 12 of which a slow fluidized bed 14 consisting of hot solid particles is maintained by feeding fluidization gas from a wind box 16 through a grid 18. The fluidized bed is provided with heat transfer surfaces 30 to recover heat from the fluidized bed.

The top portion of the chamber 12 above the fluidized bed is provided—although not illustrated in FIG. 1—with an opening or a duct, through which the fluidization air is allowed to flow from the heat exchange chamber to the furnace. The top portion of heat exchange chamber 12 above the fluidized bed 14 is also provided—as can be seen more clearly in FIG. 3—with an inlet 44 communicating with an end 46, of the return duct, through which hot solid particles flow through the inlet 24 to the fluidized bed 14.

The bottom of the heat exchange chamber 12 is provided with an outlet 50, through which solid particles can be removed from the heat exchange chamber and passed along a duct 52 to the furnace 36. The volume of the solid particle flow to be removed through the outlet 50 can be adjusted by using a valve 56 to change the volume of the fluidization and blast air to be fed through pipes 54 to the duct 52. When the volume of the solid particle flow to be removed through the outlet 50 is less than that of the hot solid particle flow entering the heat exchange chamber, the excess of the solid particles exits from the heat exchange chamber 12 directly from the upper surface of the bed 14 through an overflow opening 58 provided in a wall 60 of the heat exchange chamber below the inlet 24. The wall 60 is at the inlet 24 shared by the heat exchange chamber 12 and the furnace 36. The heat exchange chamber and the furnace may also be completely separate from each other, not sharing a wall or wall part. In the case of FIG. 2, only the uppermost part of the wall of the heat exchange chamber is shared with the furnace. If the chambers are completely separate, it is possible to arrange a duct or a pipe between them, through which the solid particles exiting from the heat exchange chamber can be returned to the furnace.

The intermediate wall 62 for restricting the mixing, which is arranged in the top portion of the heat exchange chamber 12 between the inlet 24 and the fluidized bed 14, passes the hot solid particles from the inlet toward an area 28' of the upper surface 28 of the fluidized bed 14 defined by the intermediate wall 62 and the wall 60 of the heat exchange chamber. The intermediate wall 62 and the wall 60 of the heat exchange chamber 12 form a guiding channel 66 above the fluidized bed and partially penetrating into the fluidized bed. The intermediate wall 62 extends lower than the lower edge of the overflow opening 58 and at the guiding channel prevents the free movement of the incoming material on the surface of fluidized bed 14. On the other hand, in order to avoid a major waste space, the guiding channel 66 formed by the wall 60 of the heat exchange chamber and the intermediate wall 62 may not be too long. In the example disclosed in FIG. 1, the length of the guiding channel 66 is less than 20% of the depth of the bed 14. The intermediate wall 62 extends over a distance "h" below the upper surface of the fluidized bed, the distance typically being 0–50 cm. An area $A_1$ restricted by the guiding channel from the fluidized bed is at most 30% of the average cross-sectional area A of the fluidized bed.

A portion of the hot solid particles is allowed to flow from the channel 66 through the overflow opening 58 to the furnace 36 without mixing with the solid particles in the lower portion of the guiding channel, or mixing only with a substantially small amount of cooled solid particles in the area of the guiding channel. A controllable portion of the hot solid particles flows in an uncooled state directly to the furnace. In order to have as minimal mixing of the particles in the bed 14 with the hot particles exiting through the overflow opening 58 as possible, the overflow opening is located very close to the inlet in the arrangement of FIG. 2.

Since the particles exiting through the outlet 50 come into contact with the heat transfer surfaces 30 much more so than the particles exiting through the overflow opening 58, the heat transfer efficiency of the heat exchanger 10 may be adjusted by changing the ratio of the particle flows exiting through the outlet 50 and the overflow opening 58, respectively. When the fluidization velocity of the bed 14 is constant, the heat transfer efficiency is at its highest when all particles exit through the outlet 50 and at its lowest when all particles exit through the overflow opening 58.

In a typical case, the lowest heat transfer efficiency achieved by having the discharge from the heat exchange chamber go only through the overflow 58 would be in the order of 60–80% of the maximum efficiency, if no intermediate wall 62 were provided. Due to the intermediate wall 62, the exchange of particles in the bed 14 by using minimum efficiency is insignificant and the minimum efficiency may be as low as only 20% of the maximum efficiency. This widening of the adjustment range is of great importance when various types of adjustments to the heat exchanger 10 are required.

The guiding channel 66 and the overflow opening restricting the inlet flow of the hot solid particles are formed preferably in a point, from where the solid particles may be returned in a simple manner to the furnace. In the case of FIG. 2, which shows the cross-section at the overflow opening, the overflow opening is intended to be arranged in the middle of the wall 60 of the heat exchanger. If desired, the guiding channel and the overflow opening may be provided at either side of the heat exchanger or in some other suitable place, or there could be more than just one overflow opening arranged at a distance from each other.

Figure 3:
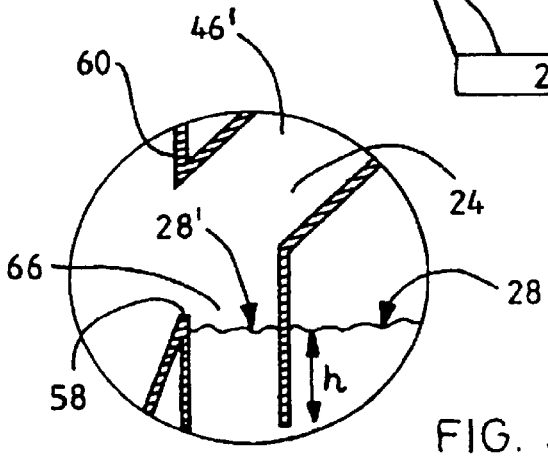
FIG. 3 schematically illustrates an enlargement of FIG. 2 at the overflow opening and a first exemplary embodiment of the invention, in which the heat exchanger in accordance with the invention is connected to the return duct in the separator of the circulating fluidized bed boiler.
Figure 4:
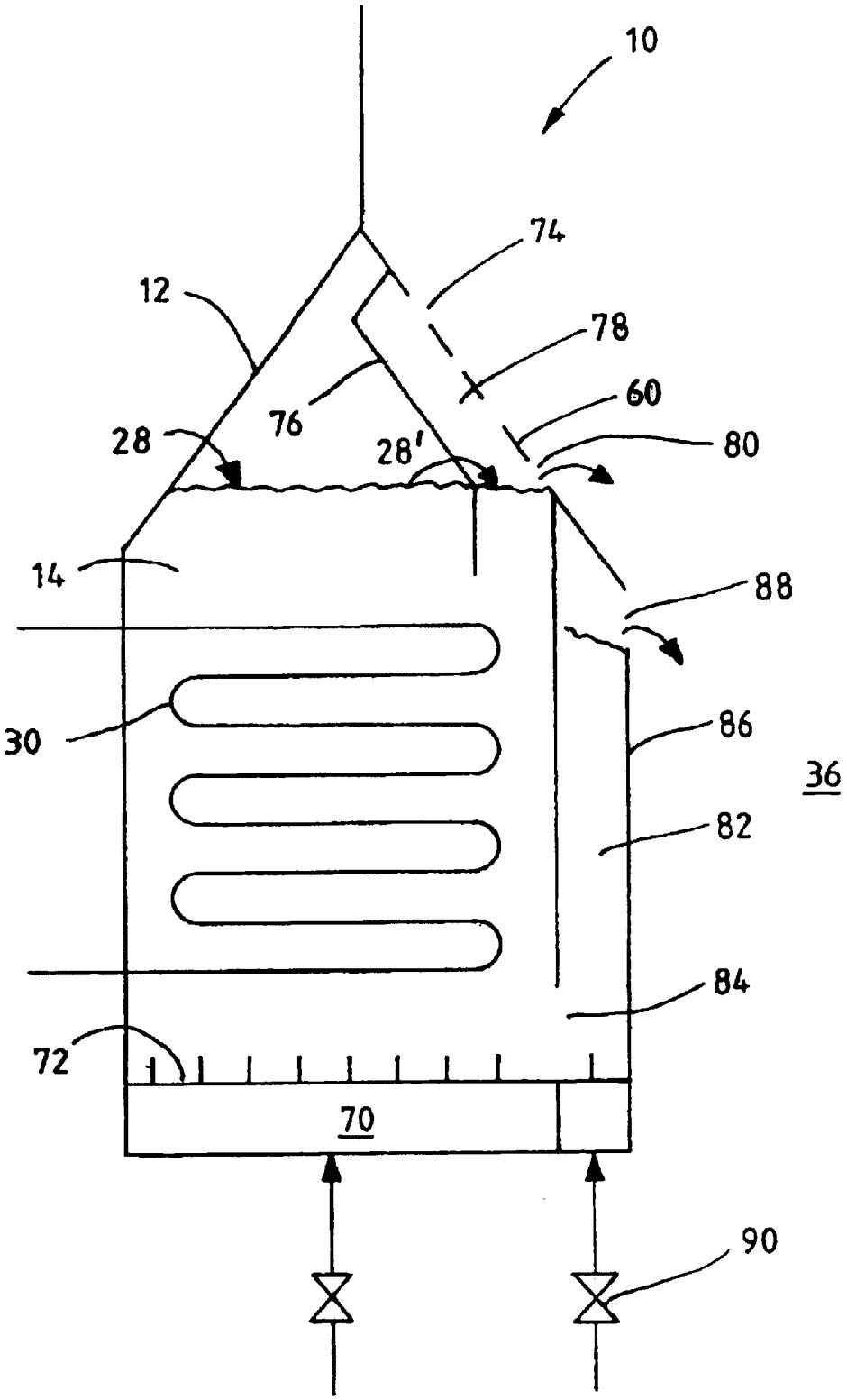
FIG. 4 schematically illustrates a cross-sectional view of a heat exchanger in accordance with a second embodiment of the invention.

In the arrangement of FIG. 4, the same reference numbers are used as in FIGS. 1, 2, and 3, wherever possible.

FIG. 4 discloses a heat exchange chamber 12 of a heat exchanger 10. The heat exchange chamber being arranged outside a wall 60 in a furnace 36 of a fluidized bed reactor, circulating fluidized bed reactor or bubbling fluidized bed reactor. A bed 14 of solid particles is fluidized by fluidization gas blown through a grid 72 from a wind box 70, and heat energy is recovered from the bed of heat transfer surfaces 30.

The flow of solid particles is passed through an inlet 74 to the upper surface 28 of the solid particle bed 14. The hot solid particles entering through the inlet 74 are passed by a guiding channel 78 formed by an intermediate wall 76 toward the fluidized bed, to a restricted area 28' on its upper surface. Hot solid particles exit through an overflow opening 80 provided in the area defined by the intermediate wall. The upper surface of the fluidized bed is flush with the lower edge of the overflow opening or higher.

A vertical lifting channel 82 is formed between the furnace 36 and the actual heat exchange chamber 12 of the heat exchanger 10. The heat exchange chamber 12 and the lifting channel 82 are in communication with each other through an outlet 84 in their respective bottom parts. The top portion of the lifting channel is provided with a second overflow opening 88 in the wall 86 shared by the lifting channel and the furnace for the removal of solid particles from the lifting channel as they overflow into the furnace.

The ratio of the volume of the solid particle flow "V" exiting through the second overflow opening 88 of the lifting channel 82 to that of the flow "v" exiting through the overflow opening 80 arranged in the top portion of the heat exchange chamber can be adjusted by a valve 90, which regulates the volume of the flow exiting through the channel 82, i.e., the fluidization. Due to the intermediate wall 76 preventing mixing, the flow exiting through the overflow opening 80 does not substantially mix with the particles in the fluidized bed 14. The solid particle flow through the overflow opening 80 consists of hot solid particles newly flown in through the inlet 74.

The invention has been described above in connection with embodiments that are presently considered as the most preferable. However, it must be understood that the invention is not limited to these embodiments only, but rather also covers a number of other arrangements within the scope of invention, as defined by the patent claims below.

Thus, it must be understood that the heat exchanger may also be arranged in communication with the reaction chamber in some other way, e.g., inside the reaction chamber. Thus, the particle inlet may be arranged to operate in communication with the inner material circulation of the reaction chamber.

Furthermore, the number of inlets and outlets, their location, and their structure may deviate from what is disclosed herein. The structure and shape of the means restricting the mixing of particles may also deviate from the embodiments disclosed herein.

What is claimed is:

1. A method of controlling heat transfer in a fluidized bed heat exchanger having a heat exchange chamber with a bed of solid particles therein, the method comprising the following steps:

(a) feeding solid particles through an inlet in an upper portion of the heat exchange chamber to the upper surface of the bed of solid particles therein by passing the solid particles along a guiding channel to a restricted area of the upper surface of the bed of solid particles defined by the guiding channel;

(b) fluidizing the bed of solid particles in the heat exchange chamber with a fluidization gas;

(c) transferring heat by heat transfer surfaces away from the fluidized bed of solid particles; and (d) removing solid particles from the heat exchange chamber through a first outlet formed in the area of the guiding channel.

2. The method of claim 1, wherein the restricted area of the upper surface of the bed of solid particles has a cross-sectional surface area that is at most 30% of the average cross-sectional area of the bed of solid particles.

3. The method of claim 1, further comprising a step of restricting horizontal movement of solid particles between the guiding channel and the rest of the of the solid particle bed with an intermediate wall, which forms one wall of the guiding channel and which extends into the bed of solid particles.

4. The method of claim 1, wherein solid particles are removed from the heat exchanger by overflow from the surface of the bed of solid particles in the heat exchange chamber.

5. The method of claim 1, wherein solid particles are removed from the heat exchanger through a first adjustable outlet in the heat exchange chamber that is below the surface of the bed of solid particles.

6. The method of claim 1, further comprising a step of removing further solid particles from the heat exchanger through a second outlet in a lower portion of the heat exchange chamber.

7. The method of claim 6, further comprising a step of adjusting the heat exchange in the heat exchanger by regulating the amount of solid particles passing through the second outlet.

8. The method of claim 1, wherein the fluidized bed heat exchanger is incorporated in a circulating fluidized bed reactor, the inlet of the heat exchange chamber is connected to a return duct of a particle separator of the circulating fluidized bed reactor, the first outlet of the heat exchange chamber leads to a furnace of the circulating fluidized bed reactor, and wherein solid particles flowing from the return duct to the heat exchange chamber are removed directly from the restricted area of the upper surface of the bed of solid particles to the furnace of the circulating fluidized bed reactor.

9. A fluidized bed heat exchanger, comprising:

a heat exchange chamber having a bed of solid particles therein;

means for feeding fluidization gas into the heat exchange chamber for fluidizing the bed of solid particles therein;

heat transfer surfaces in contact with the bed of solid particles in the heat exchange chamber;

an inlet (24, 74) arranged in an upper portion of the heat exchange chamber, through which solid particles are fed to the heat exchange chamber;

a guiding channel extending from above the upper surface of the bed of solid particles at least to the surface of the bed of solid particles, along which the solid particles are guided from the inlet to a restricted area of the upper surface of the bed of solid particles defined by the guiding channel; and a first outlet formed in the area of the guiding channel, through which solid particles are removed from the heat exchange chamber.

10. The fluidized bed heat exchanger of claim 9, wherein the restricted area of the upper surface of the bed of solid particles has a cross-sectional surface area that is at most 30% of the average cross-sectional area of the bed of solid particles.

11. The fluidized bed heat exchanger of claim 9, wherein the restricted area of the upper surface of the solid particle bed is bounded in part by a first wall of the heat exchange chamber.

12. The fluidized bed heat exchanger of claim 11, wherein the first outlet comprises an overflow opening arranged flush with the surface of the bed of solid particles.

13. The fluidized bed heat exchanger of claim 11, wherein the first outlet comprises an adjustable outlet arranged below the surface of the bed of solid particles.

14. The fluidized bed heat exchanger of claim 9, further comprising a second outlet arranged in the heat exchange chamber.

15. The fluidized bed heat exchanger of claim 14, wherein the second outlet is arranged in a lower portion of the heat exchange chamber.

16. The fluidized bed heat exchanger of claim 14, wherein the second outlet is arranged between the heat exchange chamber and a lifting channel formed adjacent to the heat exchange chamber, and an overflow opening is arranged in an upper portion of the lifting channel for the removal of solid particles from the lifting channel.

17. The fluidized bed heat exchanger of claim 9, wherein the guiding channel is bounded by a wall of the heat exchange chamber and an intermediate wall arranged in the heat exchange chamber, the intermediate wall extending from above the surface of the solid particle bed at least to the surface of the bed of solid particles.

18. The fluidized bed heat exchanger of claim 17, wherein the intermediate wall extends from the surface of the bed of solid particles to about 10–50 cm below the surface.

19. The fluidized bed heat exchanger of claim 17, wherein the intermediate wall extends into the solid particle bed to a depth that is at most 20% of the depth of the bed.

20. The fluidized bed heat exchanger of claim 9, wherein a second outlet is provided in a lower portion of the heat exchange chamber.

21. The fluidized bed heat exchanger of claim 9, wherein the heat exchange chamber is provided with a continuous bed of solid particles having a continuous fluidization.

22. A circulating fluidized bed reactor having a fluidized bed heat exchanger according to claim 9, wherein the inlet of the fluidized bed heat exchanger is connected to a return duct of a particle separator of the circulating fluidized bed reactor, and the first outlet leads to a furnace of the circulating fluidized bed reactor.

23. A fluidized bed reactor having a fluidized bed heat exchanger according to claim 9, wherein the inlet of the fluidized bed heat exchanger is connected directly to a furnace of the fluidized bed reactor.

24. The method of claim 1, wherein the restricted area of the upper surface of the bed of solid particles has a cross-sectional surface area that is at most 10% of the average cross-sectional area of the bed of solid particles.

25. The fluidized bed heat exchanger of claim 9, wherein the restricted area of the upper surface of the bed of solid particles has a cross-sectional surface area that is at most 10% of the average cross-sectional area of the bed of solid particles.

26. The fluidized bed heat exchanger of claim 17, wherein the intermediate wall extends from the surface of the bed of solid particles to about 20–30 cm below the surface.

* * * * *